United States Patent [19]

Gunn et al.

[11] Patent Number: 4,986,420

[45] Date of Patent: Jan. 22, 1991

[54] PACKAGE WITH MULTI-PLY SIDE PANELS AND STRAP HANDLE

[75] Inventors: Charles L. Gunn, Lawrenceburg, Ind.; Robert J. Apke, Cincinnati, Ohio

[73] Assignee: The Proctor & Gamble Company, Cincinnati, Ohio

[21] Appl. No.: 392,329

[22] Filed: Aug. 11, 1989

[51] Int. Cl.[5] ..... B65D 25/16; B65D 5/46

[52] U.S. Cl. ..... 206/607; 220/95; 220/462; 229/117.22

[58] Field of Search ..... 206/604, 605, 607, 608, 206/601; 220/95, 416, 462; 229/52 A, 52 AC, 52 AL, 52 AW

[56] References Cited

U.S. PATENT DOCUMENTS

| | | | |
|---|---|---|---|
| 1,646,537 | 10/1927 | Hurley . | |
| 2,645,406 | 7/1953 | Robins | 229/52 A |
| 2,915,236 | 12/1959 | Breunig | 229/52 AW |
| 2,967,656 | 1/1961 | Yergobbi | 229/52 A |
| 2,981,455 | 4/1961 | Cope | 206/607 |
| 3,157,342 | 11/1964 | Grady | 229/52 A |
| 3,692,202 | 9/1972 | Parlagreco | 220/1 BC |
| 3,768,720 | 10/1973 | Bundy | 229/52 A |
| 3,774,836 | 11/1973 | Nunn | 229/52 AL |
| 3,801,012 | 4/1974 | Thelen | 229/52 A |
| 3,927,812 | 12/1975 | Winters et al. | 224/48 R |
| 4,176,423 | 12/1979 | Wigemark | 16/125 |
| 4,344,534 | 8/1982 | Sutton | 206/545 |
| 4,516,687 | 5/1985 | Taguchi et al. | 220/94 R |
| 4,669,627 | 6/1987 | Ueda et al. | 220/94 R |

*Primary Examiner*—Paul T. Sewell
*Assistant Examiner*—Jacob K. Ackun, Jr.
*Attorney, Agent, or Firm*—R. C. Witte; T. H. O'Flaherty; J. V. Gorman

[57] ABSTRACT

A package having a handle for housing granular or similar products. The handle is a substantially flat strap handle which has a barb member on each end. The handle is inserted into two opposing openings in the side wall of the package. A section of the side wall adjacent each of the apertures includes a liner which separates the granular contents of the package from the area immediately surrounding the aperture. The liner is adapted to prevent the flow of granular contents out through the aperture. The package can be formed from a sleeve which, even with the handle inserted, is substantially flat. Also, with the package assembled the handle rests against the side wall of the package allowing shipping virtually as if the package did not have a handle.

20 Claims, 6 Drawing Sheets

PACKAGE WITH MULTI-PLY SIDE PANELS AND STRAP HANDLE

BACKGROUND OF THE INVENTION

1. Field of the Invention

The present invention relates to packages with handles, and more particularly, to such packages for storing granular products.

2. Description of Prior Art

Many products are provided to consumers in granular form which includes any form which has physical characteristics similar to granular materials, such as powders. Among the list of granular consumer products are many laundry detergents and dish washing detergents. Granular detergents are generally used in relatively large volumes. Consequently, large volumes of these products are consumed each year. Due to the vast quantity of consumer products sold in granular form, there is a great demand for packages to house these products.

Packages for granular consumer products should have several key characteristics. The package must be able to withstand the rigors of transportation from the manufacturer to the retailer and to the ultimate place of use by the consumer. It is also desirable that the package enable the consumer to remove product therefrom as simply as possible. Furthermore, the package should be easy to handle, thereby making it desirable in many instances for the package to include a handle.

Perhaps most importantly, it is desirable, particularly in today's competitive marketplace, to reduce the costs associated with packaging. These costs, of course, include the costs of the materials required to make the package. Also included in these packaging costs are the costs of making the package, shipping the empty package to the granular product manufacturer, forming and filling the package at the product manufacturer, shipping the filled package to the retailer, and all handling costs along the way.

Combining all of these features into one package for housing granular materials is not an easy task. Particularly troubling is the inclusion of a handle on a package while maintaining costs at a minimum. Handles often increase costs significantly. Sometimes the handles themselves or their attaching elements are expensive and sometimes the method of attachment is costly. Handles also, often create irregularly shaped blanks and containers which occupy excessive space increasing shipping and handling costs.

Attachment of handles to various types of containers is not new. U.S. Pat. No. 4,176,423 issued to Wigemark on Dec. 4, 1979 and U.S. Pat. No. 3,604,052 issued to Bringer on Sept. 14, 1971 are exemplary of handles attached to containers by inserting their ends into openings in the container. There is, however, nothing to prevent granular material from flowing out through the openings with this type of arrangement.

U.S. Pat. No. 4,344,534 issued to Sutton on Aug. 17, 1982 and U.S. Pat. No. 4,516,687 issued to Taguchi, et. al. on May 14, 1985 are exemplary of typical package handles attached externally to containers. These handles are attached to the container by the use of an externally mounted fitment. The fitment is generally a "U" shaped attachment and the handle fits through the space in the "U". Although this arrangement effectively prevents the escape of granular materials since there is no opening in the container, this arrangement results in increased packaging costs due to the irregularly shaped container caused by the external fitments.

It is, therefore, an object of the invention to provide a package with a handle which is suitable for housing granular materials.

It is, more particularly, an object of the invention to provide such a package:

which is able to withstand the rigors of transportation from the manufacturer to the ultimate place of use; and which enables the consumer to remove product therefrom as simply as possible;

It is, furthermore, an object of the invention to accomplish the aforementioned objectives while maintaining all packaging associated costs to a minimum.

SUMMARY OF THE INVENTION

In accordance with one aspect of the present invention there is provided a package for housing granular or similar materials. The package includes an outer body which has a top wall, a bottom wall, and a side wall which connects the top wall to the bottom wall to form an enclosure. The side wall has two apertures located therein with each aperture located on the opposite side of the package from the other. A section of the side wall adjacent each of the apertures includes a liner which separates the granular contents of the package from the area immediately surrounding the apertures and is unattached to the side wall in that area. The liner is adapted to prevent the flow of granular contents out through the aperture. A substantially flat strap handle which has at least one barb member on each end. One end is inserted into one of the apertures and the other end is inserted into the other aperture. The barb member on each end is adapted to hook the material of the outer body surrounding the respective aperture without permitting the handle to pull completely out during normal use.

BRIEF DESCRIPTION OF THE DRAWINGS

While the specification concludes with claims which particularly point out and distinctly claim the subject matter forming the present invention, it is believed that the invention will be better understood from the following description of the preferred embodiment taken in conjunction with the accompanying drawings in which like reference numerals identify identical elements and wherein:

DESCRIPTION OF THE PREFERRED EMBODIMENTS

Figure 1:
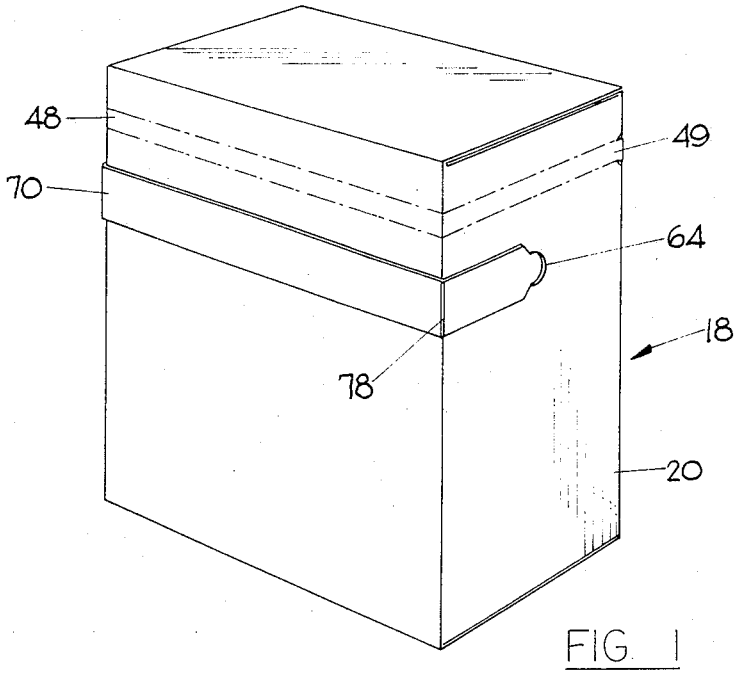
FIG. 1 is a perspective view of a preferred embodiment of the package of the present invention with the handle in the shipping position.
Figure 5:
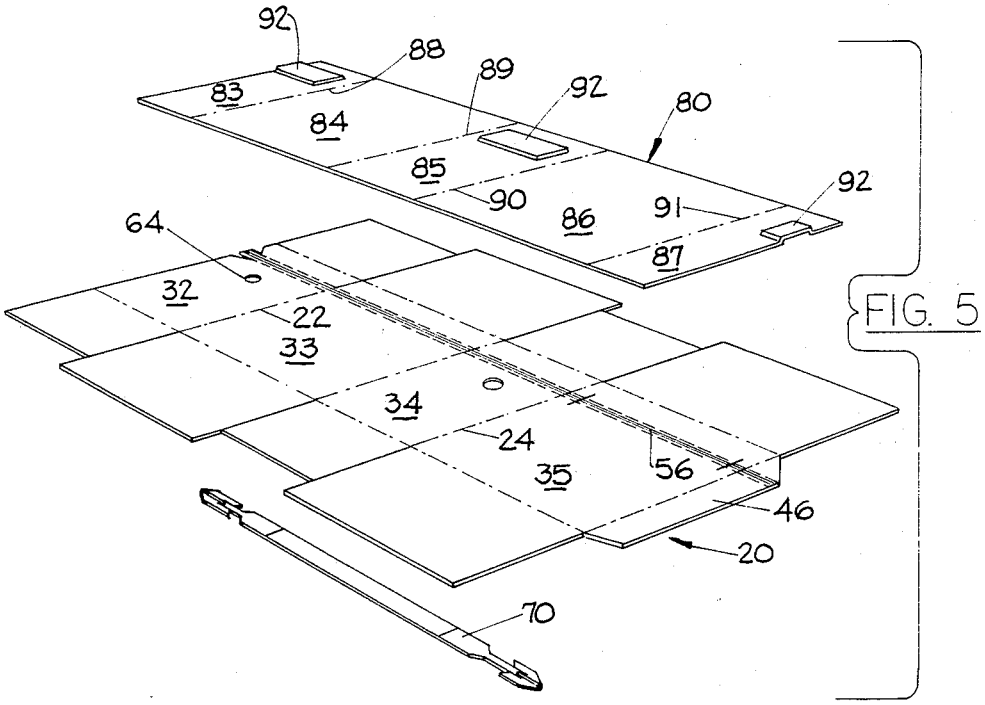
FIG. 5 is an exploded perspective view of the components which are used to make the package of FIG. 1.

Referring to FIG. 1, in a particularly preferred embodiment the present invention provides a package, indicated generally as 18, with a handle 70, the package being adapted for housing granular materials. As seen in FIG. 5, the package 18 of the preferred embodiment is assembled of several components. Among these components are an outer body 20, a handle 70 and a liner 80.

Figure 4:
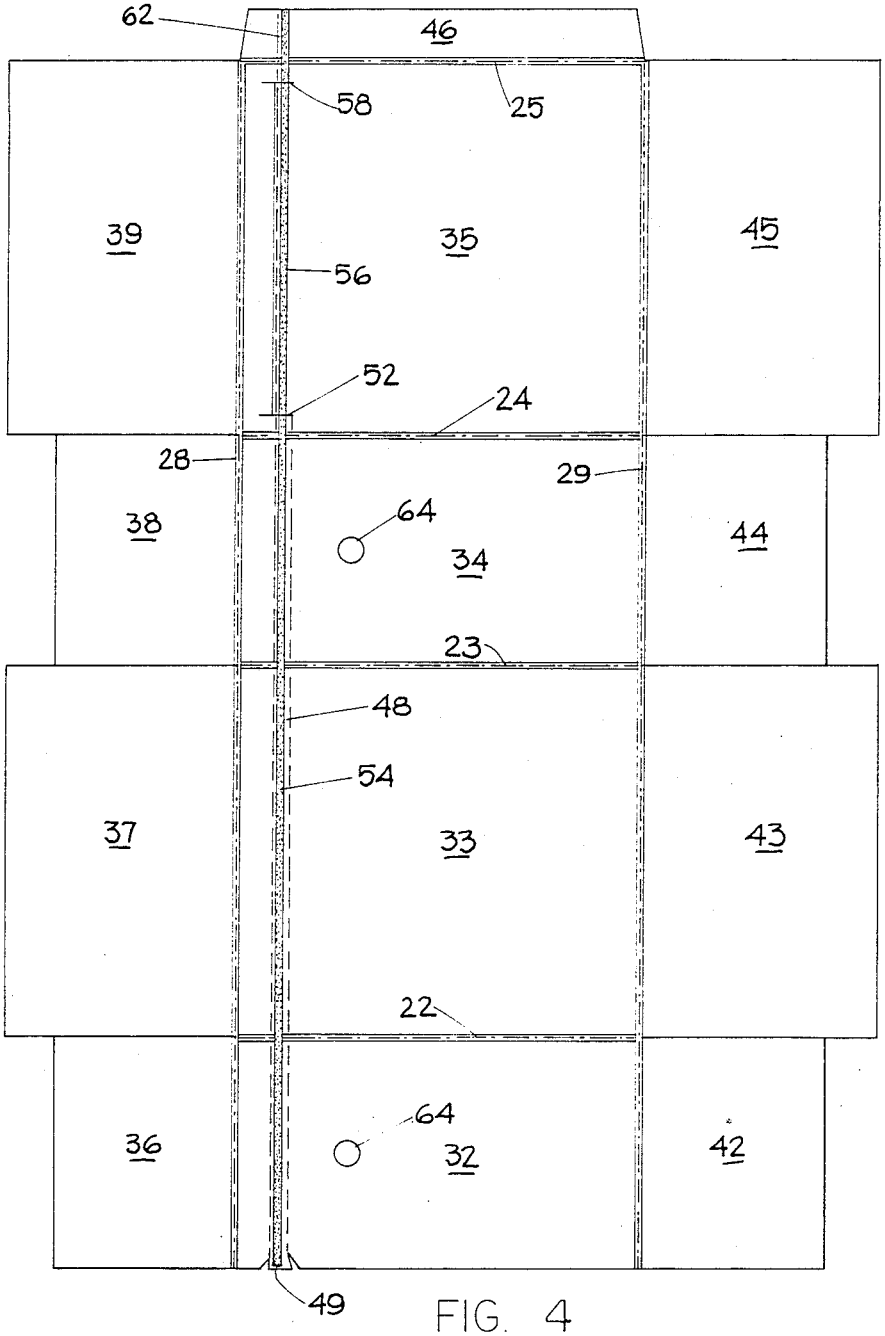
FIG. 4 is a plan view of the blank of the outer carton body used to make the package of FIG. 1.

Referring to FIG. 4, the outer body 20 is made of carton board, although other materials having similar properties can be used. The outer body 20 blank has four axial score lines 22, 23, 24, and 25 and two transverse score lines 28 and 29. The side wall of the package is formed of four segments 32, 33, 34, and 35, (first through fourth, respectively) located between the transverse score lines 28 and 29. Four flaps 36, 37, 38, and 39 are hingedly attached at score line 28 which, upon assembly, combine to make the top wall of the package 18. Similarly, four flaps 42, 43, 44, and 45 are hingedly attached at score line 29 which, upon assembly, combine to make the bottom wall. A glue seam flap 46 is hingedly attached along axial score line 25.

A tear strip 48 is scored into the side wall near the top transverse score line 28. The score lines of the tear strip 48 of the preferred embodiment are continuous cuts in the outer surface of the carton board which extend partially through the thickness of the carton board. The tear strip 48 originates at the exposed axial edge of the first side wall segment 32. At the origin of the tear strip 48 the side wall segment is notched and the tear strip 48 is enlarged to create a tab 49 to make grasping the tear strip 48 easier. The tear strip 48 terminates at a cut 52 extending through the carton board which is perpendicular to the tear strip 48 in the fourth side wall segment 35. A nylon tape 54 is preferably aligned with and attached to the tear strip 48 to reinforce it.

The fourth side wall segment 35 has a single hinge line 56 scored into it and aligned with the upper score line of the tear strip 48. The score of the hinge line 56 of the preferred embodiment is a perforated line. The hinge line 56 begins at the perpendicular cut 52 terminating the tear strip 48 and ends at a second perpendicular cut 58. Beyond the second perpendicular cut 58 is a perforated line 62 aligned with the hinge line 56 which is perforated through the remainder of the fourth side wall segment 35 and the glue seam flap 46 to allow the part above the perforation to become part of the lid of the package 18.

The first and third side wall segments, 32 and 34 respectively, have apertures 64 located therein. In the preferred embodiment the apertures 64 are in the side wall segments having the smaller transverse dimension. Although, this placement is not necessary the apertures 64 should be in alternating side wall segments so that they end up opposing each other in the package 18. The apertures 64 are positioned near the tear strip 48 approximately in the middle of the width of the segments. There must be a sufficient distance between the apertures 64 and the tear strip 48 so that the side wall of the package 18 does not tear out when a full package 18 is carried by the handle 70.

Figure 8:
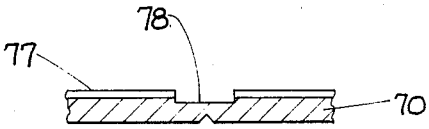
FIG. 8 is a fragmentary cross sectional view of the handle taken along line 8—8 of FIG. 7.
Figure 7:
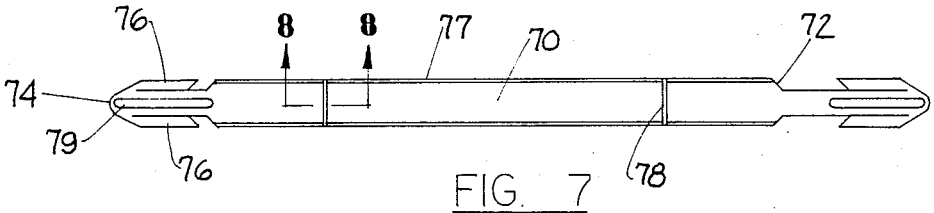
FIG. 7 is a plan view of the handle of the embodiment of FIG. 1.
Figure 9:
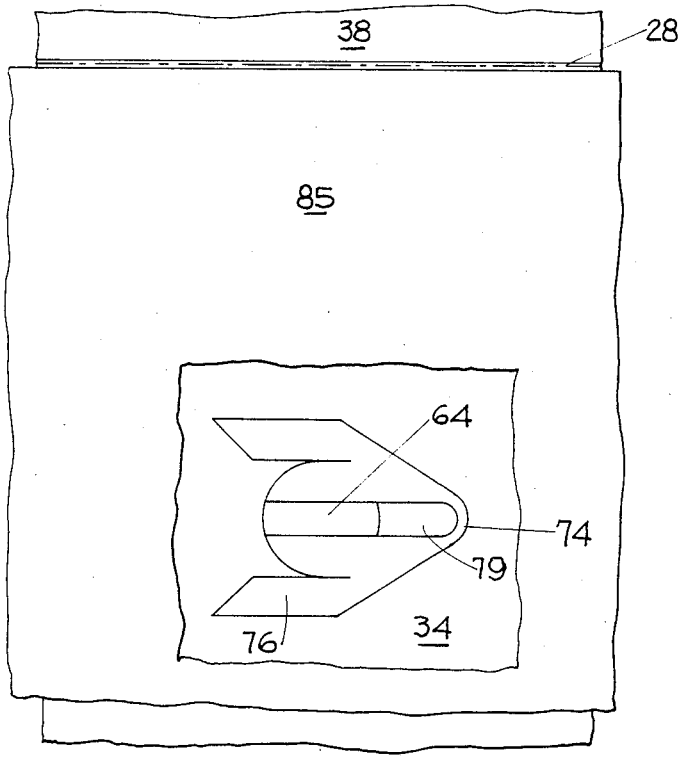
FIG. 9 is a fragmentary plan view of the handle inserted into the apertures.

As seen in FIG. 9, a handle 70 is inserted into the apertures 64 of the outer body 20. One end of the handle 70 is inserted into one of the apertures 64 and the other end of the handle 70 is inserted into the other aperture 64. Referring to FIG. 7, the handle 70 of the preferred embodiment is a virtually flat strap handle 70 with a relatively wide section in the middle and a relatively thin section on each end. A shoulder 72 is located near each end of the handle 70 which provides a transition from the wide to the thin sections. The thin sections have a generally arrowhead shaped tip 74 which includes two barb members 76 and a centrally located orifice 79. This configuration allows the ends of the barb members 76 near the tip 74 to be attached to each other. Due to the attachment there is only one tip 74 which must be directed through the aperture 64 rather than two tips (one from each barb member 76) which must be so directed. The attachment of barb members 76 also tends to force the barb members 76 apart thereby helping to assure that the tip 74 will regain shape once inserted providing proper attachment of the handle 70. The middle, wide portion of the strap handle 70 has a thickened ridge on either axial edge 77. Two transverse score lines 78 are located an axial distance from each other which is approximately equal to the width of the large side wall segments of the outer body blank 20. These score lines 78 are seen enlarged in FIG. 8. The total axial length of the wider portion of the strap handle 70 is approximately equal to the distance between the centers of the two apertures 64, the sections of the handle 70 of small width are completely inserted through the apertures 64 when the handle 70 rests against the package 18.

Figure 6:
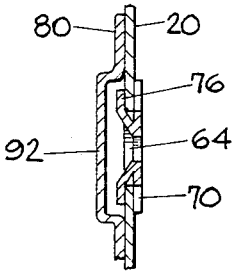
FIG. 6 is a fragmentary cross sectional view of the side wall of the package of FIG. 1 taken along line 6—6 of FIG. 3.

Referring to FIG. 5, a liner 80 is attached to the outer body 20 blank. Attachment is provided by applying glue to the outer body 20 blank. The paper board liner 80 has five segments 83, 84, 85, 86 and 87 separated by four axial score lines 88, 89, 90 and 91. The score lines 88, 89, 90 and 91 of the preferred embodiment are perforated lines. Each of the three middle segments 84, 85 and 86 are only slightly smaller than corresponding side wall segments 33, 34 and 35 of the outer body 20. The remaining two segments 83 and 87 combine to become slightly smaller than the remaining side wall segment 32 of the outer body 20. The dimensions of the liner side wall segments 83, 84, 85, 86 and 87 are smaller than the dimensions of the outer body side wall segments 32, 33, 34 and 35 so the liner fits snugly inside the outer body 20 when the package 18 is formed. Embossed areas 92 are preferably located on the liner 80 (although it may be in the outer carton body as well) such that it will create a thin cavity, as seen in FIG. 6, between the liner 80 and the outer body 20 adjacent the area immediately surrounding the apertures 64.

Figure 10:
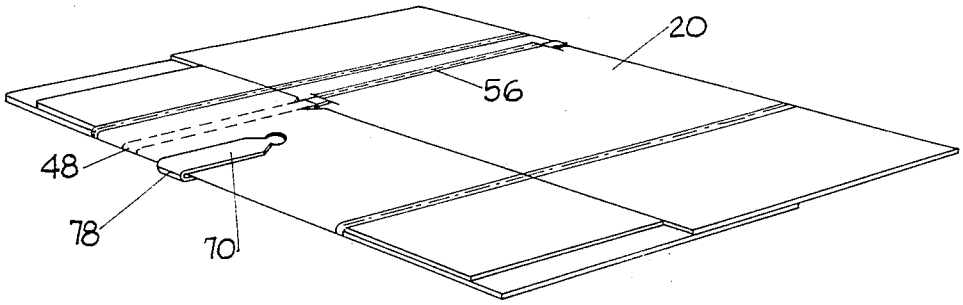
FIG. 10 is a perspective view of the sleeve used to make the package of FIG. 1.

Referring to FIG. 5, once attached, the outer body 20 and liner 80 are then folded along their score lines 24 and 91 respectively. Glue is placed along the outer body 20 glue seam flap 46 and the liner 80 side wall segment 87. Next, the outer body 20 and liner 80 are folded along their score lines 22 and 88 respectively which results in the liner 80 being glued to itself and the outer body 20 being glued to itself creating a sleeve, seen in FIG. 10. This also causes the handle 70 to bend at one of its score lines 78. The handle 70 is flat against this sleeve. In this relatively flat position the package 18 can then be bundled and shipped to the manufacturer of granular material. Upon receipt by the manufacturer of granular material the package 18 is assembled and filled as with any other standard carton using standard machinery.

Referring to FIG. 1, the result is an assembled package 18 filled with granular material. The package 18 has a top wall, a bottom wall and a side wall. The side wall connects the top wall to the bottom wall to form an enclosure. The side wall has two apertures 64 therein and each aperture 64 is located opposite the other. The liner 80, as seen in FIG. 6, provides a means for preventing the flow of the granular contents out through the apertures 64. The liner 80 is located adjacent the apertures 64, separating the contents of the package 18 from the area immediately surrounding the apertures 64. As seen in FIG. 7, the substantially flat strap handle 70 has barb members 76 on each end. Referring to FIG. 6, one end of the handle 70 is inserted into one of the apertures 64 and the other end of the handle 70 is inserted into the other aperture 64. As seen in FIG. 9 the barb members 76 on each end are adapted to grasp the material of the outer body 20 surrounding the aperture 64 without permitting the handle 70 to pull completely out of the aperture 64 during normal use. The strap handle 70 has its ends inserted into the apertures 64 placing them between the outer body 20 and the liner 80. An embossed area 92 provides added room for the ends of the handles 70 in this area. Referring to FIG. 1, the handle 70 in the shipping position rests close against the side wall of the package 18. This makes loading the package 18 for shipment to the retailer virtually identical to a similar package without a handle 70.

Figure 2:
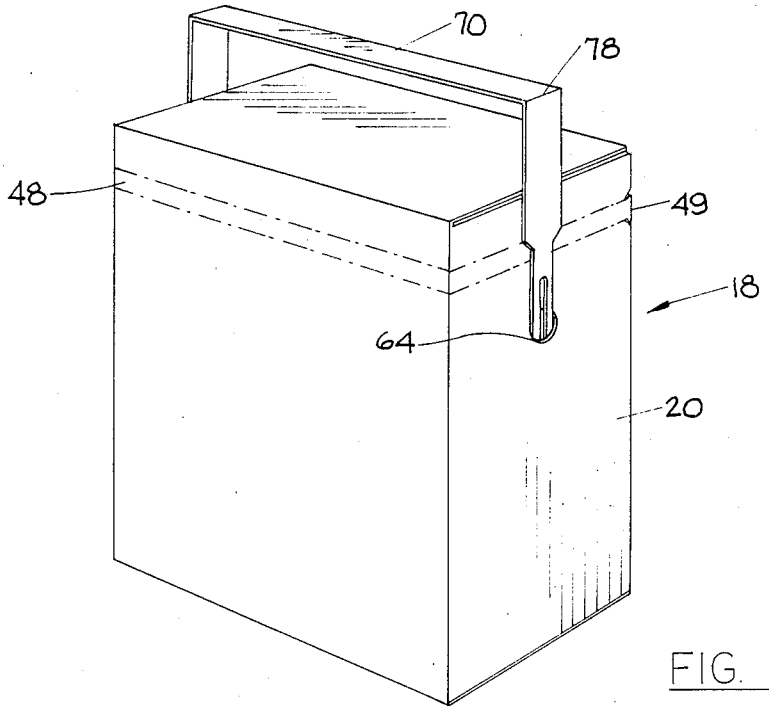
FIG. 2 is a perspective view of the embodiment of FIG. 1 with the handle in the carrying position.

To transport the packages 18 from the retailer, the consumer grasps the handle 70, pulls it away from the side of the package 18 and rotates it to a carrying position over the enclosure, as seen in FIG. 2. As the handle 70 is pulled out, the thin section of the handle 70 pulls out of each aperture 64 until the barb member 76 catches on the material of the outer body 20 surrounding the aperture 64. The consumer then transports the package 18 with the aid of the handle 70 to the ultimate place of use of the granular product.

Figure 3:
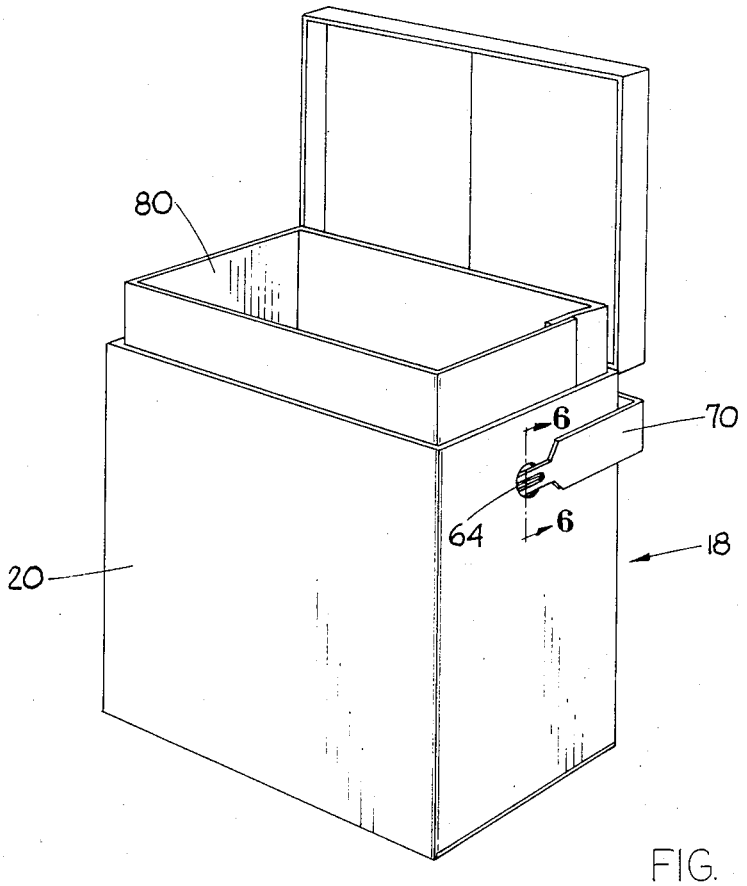
FIG. 3 is a perspective view of the embodiment of FIG. 1 with the handle out of the way and the package open.

To use the granular material the package 18 must be opened. To open the package 18 the consumer rotates the handle 70 down toward either side of the package 18 and grasps the grasping tab 49 of the tear strip 48 and removes the tear strip 48. The tear strip 48 is assured of not tearing through the fourth side wall segment 35 of the package 18 by the perpendicular cut 52. The consumer then rotates the lid which is connected to the side wall by the hinge line 56 to the open position, seen in FIG. 3. The liner 80 of the preferred embodiment sticks up past the outer body 20 once the tear strip 48 is removed. This provides a structure for the lid to rest upon in the closed position.

Another function of the liner 80 is to provide a means for preventing the flow of the granular contents out of the package 18 through the apertures 64. Referring to FIG. 6, to do this the liner 80 should be located in the final full package 18 covering the apertures 64 and separating the granular material from the area immediately surrounding the apertures 64. The separation should be such that the likelihood that any significant portion of the granular material will find its way out through the apertures 64 is substantially nonexistent. In the preferred embodiment, for example, the granular content would have to work its way between the liner 80 and the outer body 20 and out the aperture 64.

There are other liners 80 besides the liner 80 of the preferred embodiment for preventing the flow of the granular contents out of the package 18 through the apertures 64. In a second embodiment (not shown) a carton board patch is placed over each aperture 64 and the area immediately surrounding the apertures 64 forming an inner ply. The patch is attached to the outer body 20 by glue which completely circumscribes the patch thereby providing a barrier to granular movement toward the apertures 64. The patch has an embossed area to create a thin cavity between itself and the outer carton body 20. In a third embodiment (not shown) the granular contents could be contained by a plastic inner ply or bag inserted into the outer body 20.

Figure 11:
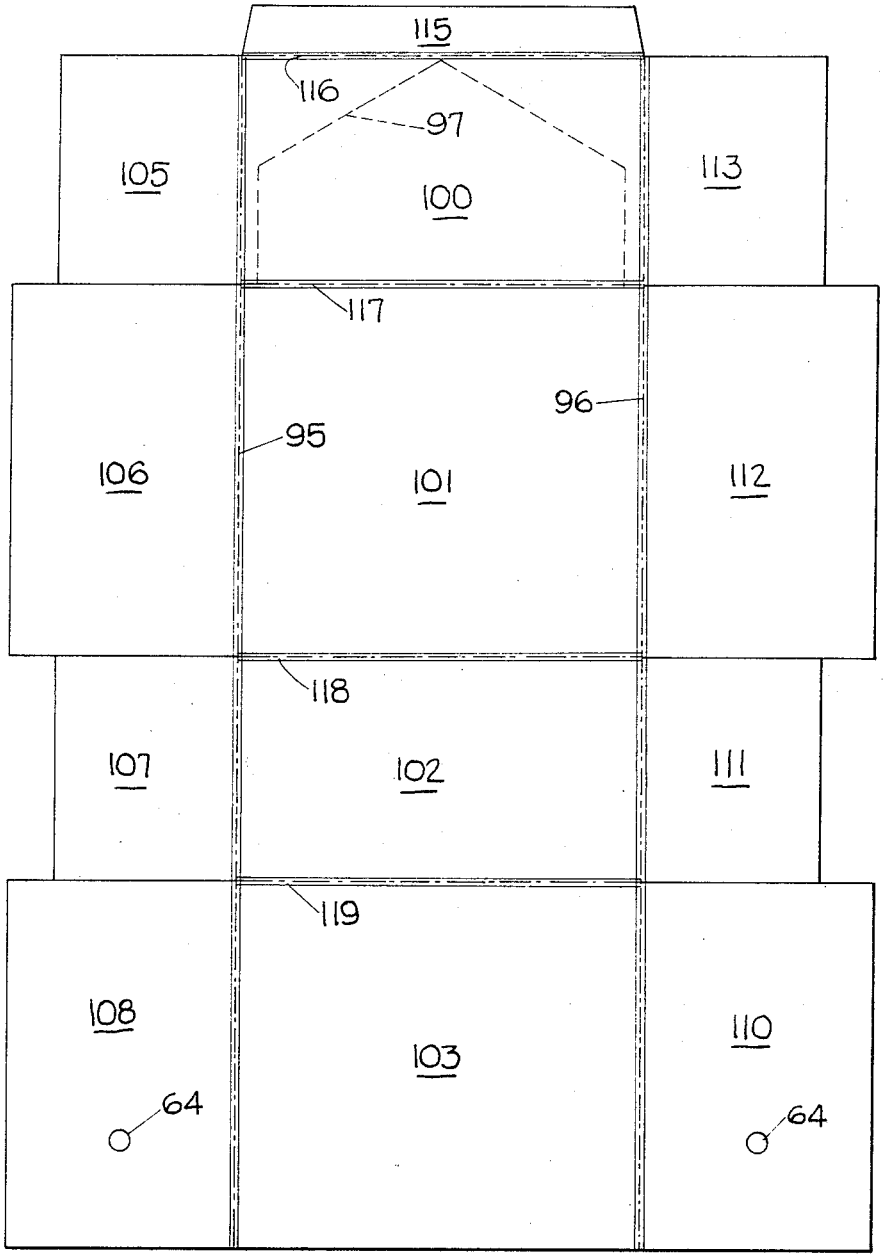
FIG. 11 is a plan view of a blank used to make an alternative embodiment.

In a fourth embodiment the liner 80 which prevents the granular material from flowing out of the package 18 through the apertures 64 is the flaps of the outer body 20. A blank which can be used to create this embodiment is seen in FIG. 11. The apertures 64 are centrally located axially within the flaps 108 and 110 and a transverse distance from the axial edge sufficient to ensure that the side wall of the package 18 does not tear out when the full package 18 is carried by the handle 70.

In this embodiment, segment 100 is the top wall and segment 102 is the bottom wall. The remaining segments and flaps form the side wall. The manufacturer of the package 18 folds the package, as before, along score line 117 and 119 and glues the glue flap 115 to side wall segment 103 and inserts the handle 70 to form the sleeve. There is no need to attach a separate liner 80.

To assemble the package 18 for filling, the flaps of one side are assembled. To do this, the minor flaps 107 and 105 are folded in first, these are followed by flap 106 and lastly flap 108. Flap 106 and 108 are glued to each other around the outer axial edge of flap 106 which provides a barrier to granular movement. The package 18 is then filled from the remaining unassembled side. Then the package is sealed by assembling the remaining flaps 110, 111, 112 and 113 as with the previous flaps 105, 106, 107 and 108.

Lastly, the package 18 should include some sort of top opening feature to allow access to the granular contents. One such feature is to provide a cut score line 97 which runs parallel to and slightly axially inwardly of score line 96, beginning at score line 117. About midway through the transverse dimension of the top wall 100 the score line 97 turns and heads diagonally toward the midpoint of the score line 116. Once reaching this midpoint the score line 97 continues as a mirror image on the other half of the top wall 100 until it terminates at score line 117. This opening feature score line 97 is similar to the tear strip 48 score lines in that it extends from the exterior partially through the thickness of the carton board. To open the package 18, the consumer presses at the corner of the score line 97 near score line 116 with a finger. Once the finger pushes through the carton board the consumer can grasp the carton board peeling back the portion of the top wall 100 between the score line 97 revealing the granular material.

While particular embodiments of the present invention have been shown and described, modification may be made to the package o without departing from the teachings of the present invention. Accordingly, the present invention comprises all embodiments within the scope of the appended claims.

What I claim is:

1. A top opening package for housing granular or similar materials, such package comprising:

(a) an outer body having a top wall, a bottom wall, and a side wall connecting the top wall to the bottom wall to form an enclosure, the side wall having two apertures therein, each aperture being located on the opposite side of the package from the other;

(b) a section of the side wall adjacent each of the apertures incuding a liner separating the granular contents of the package from the area immediately surrounding the aperture, the liner being unattached to the outer body in such area and adapted to prevent the flow of the granular contents out through the aperture; and (c) a substantially flat strap handle having at least one barb member on each end, one end of the handle being inserted through one of the apertures into a space between the liner and the outer body and the other end of the handle being inserted through the other aperture into a space between the liner and the outer body so that the end of each handle is moveable in the space between the liner and the outer body, the barb member on each end being adapted to hook the material of the outer body surrounding the respective aperture without permitting the handle to completely pull out of the apertures during normal use.

2. A top opening package according to claim 1 wherein the liner is a paper board inner ply.

3. A top opening package according to claim 1 wherein the liner is a plastic inner ply.

4. A top opening package according to claim 2 wherein the paper board liner is a flap of the outer body.

5. A top opening package according to claim 3 wherein the plastic liner is a plastic bag completely encasing the granular contents.

6. A top opening package according to claim 2 wherein the liner is a paper board inner ply which completely lines the sides of the package.

7. A top opening package according to claim 1 wherein the package is formed from a sleeve each end of the strap handle being inserted into its respective aperture; the strap handle resting flat against the side wall portion of the sleeve thereby permitting the sleeve to be easily stacked with other sleeves.

8. A top opening package according to claim 2 wherein the package is formed from a sleeve each end of the strap handle being inserted into its respective aperture; the strap handle resting flat against the side wall portion of the sleeve thereby permitting the sleeve to be easily stacked with other sleeves.

9. A top opening package according to claim 3 wherein the package is formed from a sleeve each end of the strap handle being inserted into its respective aperture; the strap handle resting flat against the side wall portion of the sleeve thereby permitting the sleeve to be easily stacked with other sleeves.

10. A top opening package according to claim 1 wherein the handle has two positions, a shipping position wherein a handle end is pushed a distance into the aperture such that the handle rests substantially against the side wall of the box, and a carrying position against the top of the box and the third position wherein the handle is located over and a distance away from the top wall of the box.

11. A top opening package according to claim 2 wherein the handle has two positions, a shipping position wherein a handle end is pushed a distance into the aperture such that the handle rests substantially against the side wall of the box, and a carrying position wherein the handle is located over and a distance away from the top wall of the box.

12. A top opening package according to claim 3 wherein the handle has two positions, a shipping position wherein a handle end is pushed a distance into the aperture such that the handle rests substantially against the side wall of the box, and a carrying position wherein the handle is located over and a distance away from the top wall of the box.

13. A top opening package according to claim 1 wherein the package has the shape of a cube and wherein the package further comprises a tear strip around three sides of the cube such that when the tear strip is removed the lid may be moved to an open position allowing access to the granular contents.

14. A top opening package according to claim 2 wherein the package has the shape of a cube and wherein the package further comprises a tear strip around three sides of the cube such that when the tear strip is removed the lid may be moved to an open position allowing access to the granular contents.

15. A top opening package according to claim 3 wherein the package has the shape of a cube and wherein the package further comprises a tear strip around three sides of the cube such that when the tear strip is removed the lid may be moved to an open position allowing access to the granular contents.

16. A top opening package according to claim 1 wherein the liner has an embossed area adjacent each of the apertures forming a thin cavity between the outer body and the liner.

17. A top opening package according to claim 2 wherein the liner has an embossed area adjacent each of the apertures forming a thin cavity between the outer body and the liner.

18. A top opening package according to claim 1 wherein the liner is attached to the outer body by glue completely circumscribing the aperture providing a barrier to granular movement.

19. A top opening package according to claim 2 wherein the liner is attached to the outer body by glue completely circumscribing the aperture providing a barrier to granular movement.

20. A top opening package according to claim 3 wherein the liner is attached to the outer body by glue completely circumscribing the aperture providing a barrier to granular movement.

* * * * *

UNITED STATES PATENT AND TRADEMARK OFFICE

CERTIFICATE OF CORRECTION

PATENT NO. : 4,986,420

DATED : 1/22/91

INVENTOR(S) : Charles L. Gunn, et. al.

It is certified that error appears in the above-identified patent and that said Letters Patent is hereby corrected as shown below:

On the Title page, Assignee section, "Proctor" should read -- Procter --.

On the Title page, item [56], "Yergobbi" should read -- Vergobbi -- .

Column 2, line 11, ";" should read -- . --

Column 6, line 32, "Flap", second occurrence, should read -- Flaps -- .

Column 6, line 62, after "package" delete -- o -- .

Column 8, line 2, delete -- against the top of the box and the third position -- .

Signed and Sealed this

Twenty-third Day of February, 1993

*Attest:*

STEPHEN G. KUNIN

*Attesting Officer*

*Acting Commissioner of Patents and Trademarks*